US006244380B1

(12) United States Patent
Naccarato

(10) Patent No.: US 6,244,380 B1
(45) Date of Patent: Jun. 12, 2001

(54) PERSONAL FIRE ESCAPE ASSEMBLY DEVICE

(76) Inventor: Anthony Naccarato, 9022 Krier Pl., Brooklyn, NY (US) 11236

( * ) Notice: Subject to any disclaimer, the term of this patent is extended or adjusted under 35 U.S.C. 154(b) by 0 days.

(21) Appl. No.: 09/489,569

(22) Filed: Jan. 21, 2000

(51) Int. Cl.[7] ..... E06C 9/00
(52) U.S. Cl. ..... 182/70; 182/196
(58) Field of Search ..... 182/70, 73, 74, 182/76, 196–199

(56) References Cited

U.S. PATENT DOCUMENTS

| | | | | |
|---|---|---|---|---|
| 113,357 | * | 4/1871 | Burrows . | |
| 755,666 | * | 3/1904 | Horton . | |
| 906,954 | * | 12/1908 | Spowholz . | |
| 1,753,798 | | 4/1930 | Martin | 182/70 |
| 3,344,886 | | 10/1967 | Boscarino, Jr. | 182/70 |
| 4,164,991 | | 8/1979 | Marra | 182/70 |
| 4,383,592 | | 5/1983 | Hoffa | 182/70 |
| 4,595,075 | | 6/1986 | Rodrigue | 182/70 |
| 4,705,141 | | 11/1987 | Splaine | 182/48 |
| 5,022,491 | * | 6/1991 | Gill . | |
| 5,311,965 | | 5/1994 | Wu | 182/85 |
| 5,842,539 | | 12/1998 | Hough | 182/70 |

FOREIGN PATENT DOCUMENTS

| | | | | |
|---|---|---|---|---|
| 1118610 | * | 6/1958 | (DE) | 182/196 |
| 218764 | * | 4/1987 | (EP) | 182/70 |

* cited by examiner

*Primary Examiner*—Alvin Chin-Shue
(74) *Attorney, Agent, or Firm*—Steven Horowitz

(57) ABSTRACT

A simple and relatively lightweight personal fire escape assembly device attaches to the non-ground floor of a patio of a high rise building and provides an easy escape route to the patio of the floor below in the event of emergency. Device includes three stackable annular ring elements, namely, a cover, a hollow center ring and a bottom disc. The center ring and bottom disc attach to the top and bottom, respectively, of a ladder and a series of chain elements. The hollow center ring also attaches to a hinge bracket which connects to the transverse piping part of U-shaped piping made of two vertical pipes and a transverse horizontal pipe where the vertical pipes are fastened to the floor of the patio. In stored position the device other than the piping hangs down from the piping by means of the hinge bracket. In an emergency the user rotates the device 270 degrees so that the hinge bracket of the device rests on the railing of the patio and the rings extend beyond the railing. User removes the cover ring. The bottom ring, ladder and chain elements fall out to the patio below. User then climbs through center ring and holding onto chain elements navigates the ladder down to the patio below. Device is made from 16 to 18 gauge noncorrosive aluminum. Includes various optional features including removable mallet, automatic alarm signal to doorman and step ladder to facilitate climbing onto device in active position.

28 Claims, 8 Drawing Sheets

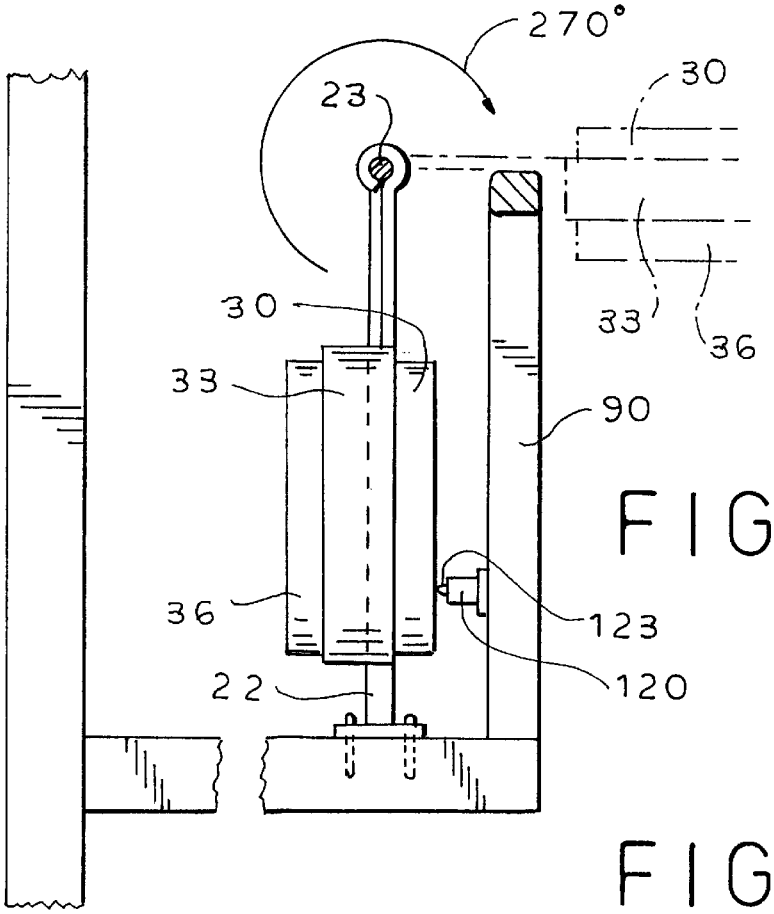
FIG. 2
FIG. 5
FIG. 6
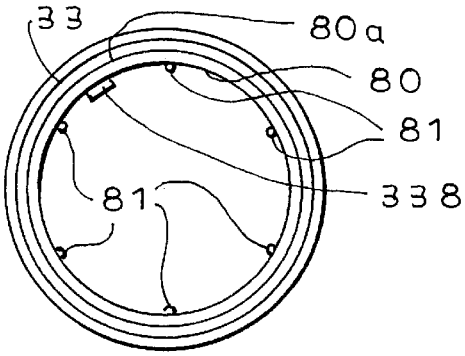
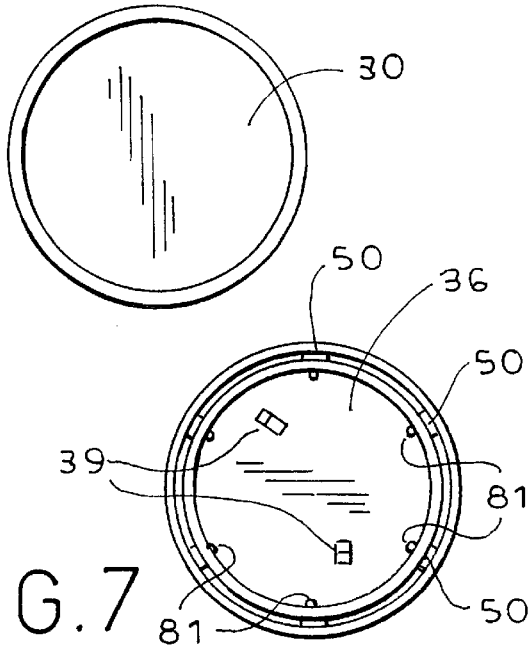
FIG. 7

FIG. 9
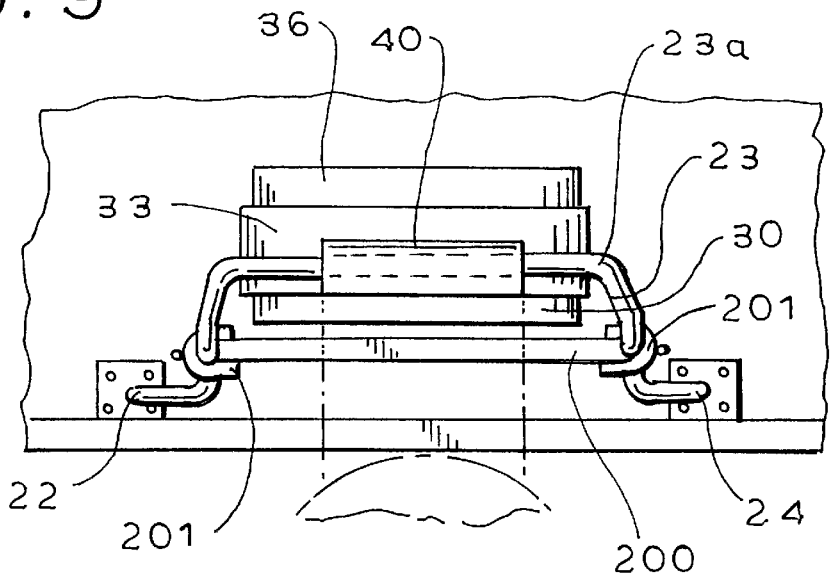
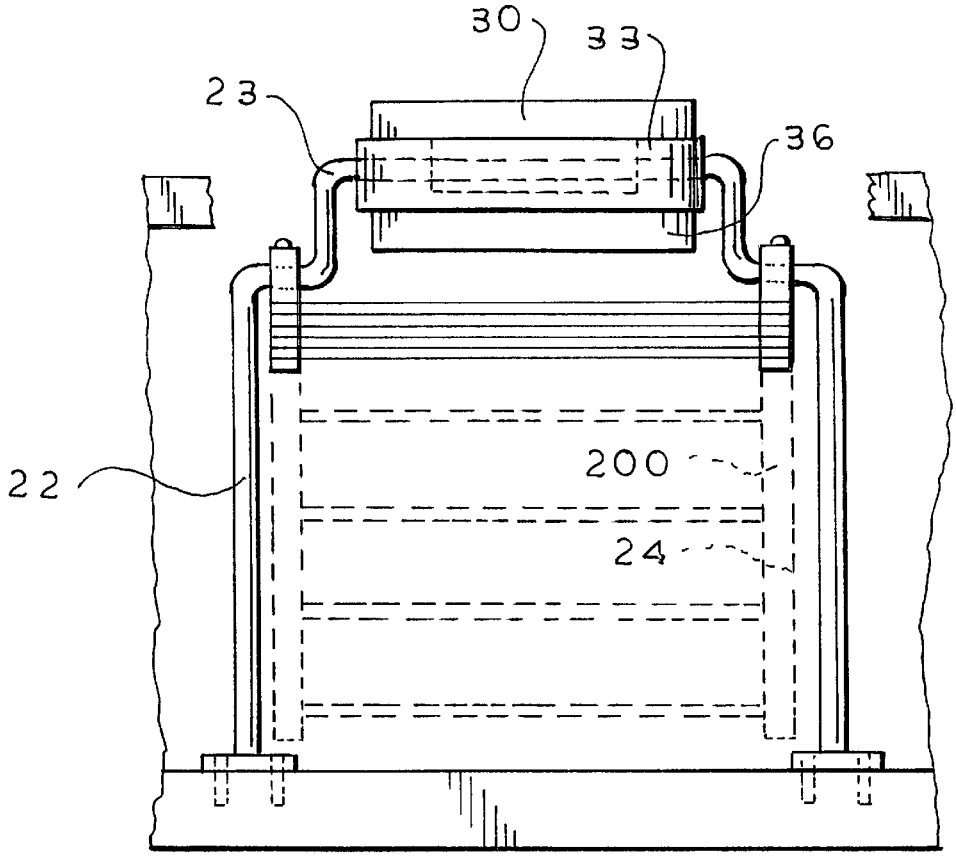
FIG. 10

PERSONAL FIRE ESCAPE ASSEMBLY DEVICE

The present invention relates generally to fire escapes and more particularly to personal fire escapes of high rise buildings that can be purchased and installed on one's patio or near a bedroom window to be used in the event of an emergency.

Modern high rise buildings often have patios. While modern buildings are always constructed with fire escapes, it is not the case that such buildings commonly have means to escape from the patio of the apartment. In the event of a fire, the traditional means of escape may be blocked or unavailable. Furthermore it is always preferable to have an additional means of escaping a fire. Many such buildings do not have means to escape from the patio.

The present invention addresses these concerns. The following important objects and advantages of the present invention are:

(A) to provide a simple to manufacture and easy to operate fire escape device that is readily attachable to a floor of an above ground patio of an existing high rise building, (B) to provide a fire escape assembly device that contains three stackable ring elements including a cover, a hollow center ring and a bottom disk that together contain a ladder and circumferentially spaced chain elements attached from the center ring and the bottom disc so that an individual escaping a fire can when the device hangs over an outer railing of a patio climb through the center ring and climb down the ladder to an escape floor, (C) to provide a fire escape device that includes ring elements, including a cover, that contain and store a ladder and chain elements whereby in stored position the ring elements hang on piping by means of a hinge bracket, which piping is attached to a patio, and whereby the device is activated when the hinge bracket and ring elements are rotated on the piping approximately 270 degrees so that the hinge bracket rests on the outer railing of the patio and the ring elements extend over the outer railing of the patio and the cover is removed thereby allowing the stored ladder and chain elements to fall and provide means of escape, (D) to provide a fire escape device that includes a ladder whereby the individual using the ladder would be surrounded on all sides by chain elements to which can be added include horizontal connective chains so that if the individual climbing down the ladder loses balance the individual can grab any part of the chain elements to restore balance, (E) to provide a fire escape device that is made of noncorrosible 16 to 18 gauge aluminum, (F) to provide a fire escape device that can include a mallet for braking into a window on an escape floor if necessary, (G) to provide a fire escape device that can include an alarm that electrically and automatically signals a remote station such as a doorman in the building through wires when the fire escape device is separated from a circuitbreaking jack element extending from the railing of the patio as the device is rotated into active position;

(H) to provide a fire escape device that has added stability in active position by means of a small bracket with a central aperture extending from the center ring that can be fastened to an overhead canopy such as with a bar having a hook;

(I) to provide a fire escape device whose transverse piping can be bent so as to allow placement of a convenience step ladder under the piping safe from tampering by children in order to make it easier to climb onto the hinge bracket and into the center ring when the device is placed in active position; and (J) to provide a fire escape device that can be used on patios or in bedrooms.

U.S. Pat. Nos. 5,842,539 to Hough, 5,311,965 to Wu, 4,705,141 to Splaine, 4,595,075 to Rodrigue, 4,383,592 to Hoffa, 4,164,991 to Marra and 1,753,798 to Martin disclose various kinds of fire escape devices and ladders that can be used in various ways but each suffers from various disadvantages. The wooden storage box of U.S. Pat. No. 5,842,539 used to store and anchor the ladder could itself catch fire and burn. The extensible ladder of U.S. Pat. No. 3,344,886 to Boscarino does not provide a series of chain elements or other structure surrounding the person using the ladder that can be used to hold on to if the person climbing down the ladder loses balance. No known prior art fire escape assembly device discloses a structure as described in the present invention that affords all the advantages of the present invention.

BRIEF DESCRIPTION OF THE DRAWINGS

FIG. 2 is side elevational view of the fire escape device of the present invention in stored position with broken lines depicting a portion of the device in active mode.

FIG. 5 is a bottom plan view of the cover of the fire escape device of the present invention.

FIG. 6 is a top plan view of the center ring of the fire escape device of the present invention.

FIG. 7 is a top plan view of the bottom disc of the fire escape device of the present invention.

FIG. 9 depicts a top plan view of the device of the present invention showing an alternative embodiment of the piping and including a convenience step ladder.

FIG. 10 is a front elevational view of the fire escape device of the present invention in active mode including an alternative embodiment of a convenience step ladder.

DETAILED DESCRIPTION OF THE DRAWINGS AND PREFERRED EMBODIMENT

Figure 1:
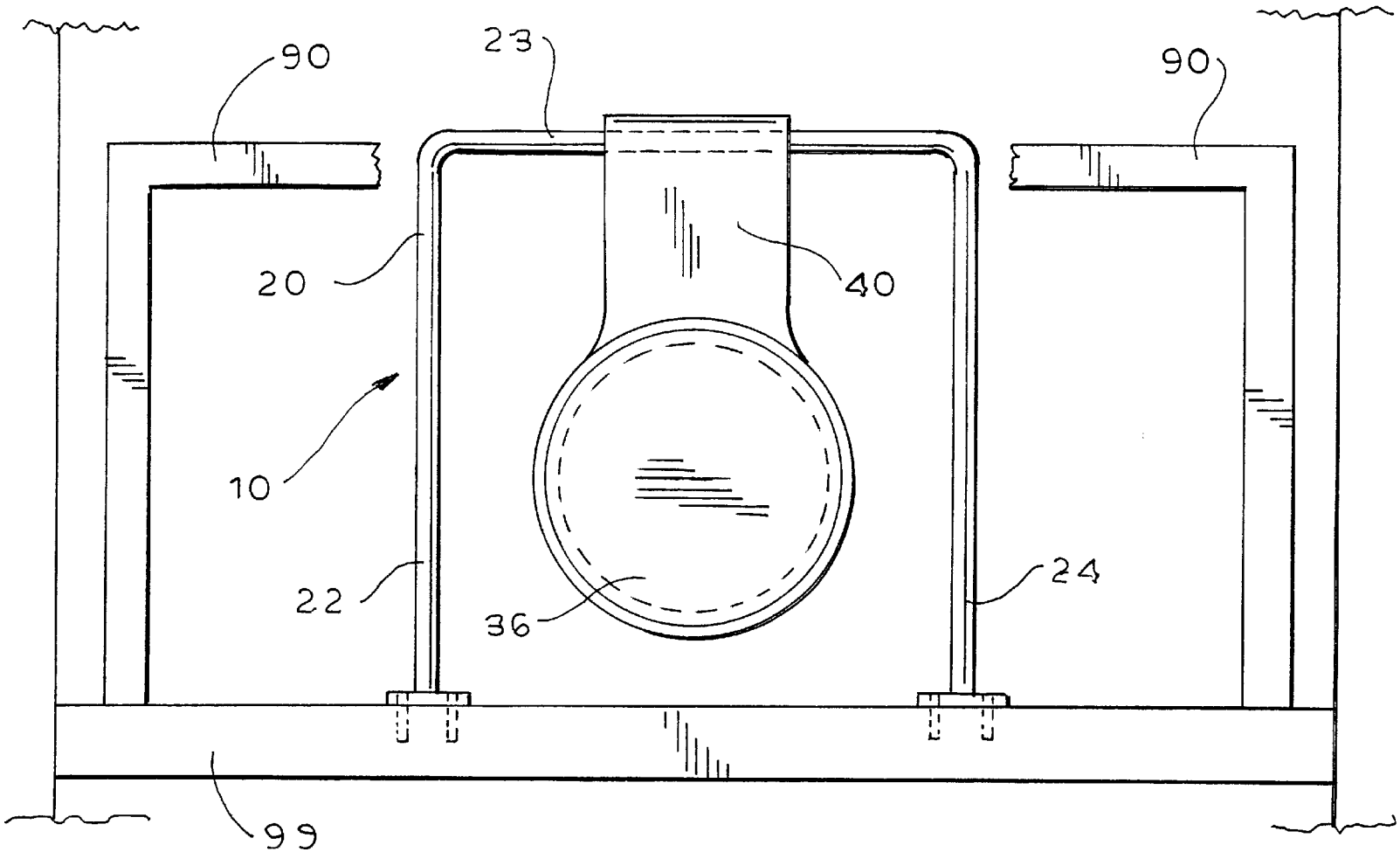
FIG. 1 is a front elevational view of the fire escape device of the present invention in stored position.

In order to better understand the present invention in conjunction with the drawings of FIGS. 1–11, the fire escape assembly of the present invention is assigned reference numeral 10 and its elements are described and assigned the reference numerals identified below.

As seen from FIGS. 1–11, the device 10 includes piping 20. Piping 20 includes at least two vertical upright pipes 22, 24 and a transverse pipe 23 running approximately parallel to a floor 16 of the patio 15. Transverse pipe 23 connects vertical upright pipes 22, 24. Each vertical upright pipe 22, 24 is fastened to the floor of the patio by any well known means such as drilling a hole in the floor and inserting a screw that penetrates a flange on the end of the vertical piping.

Device 10 also includes three annular ring elements 30, 33, 36 that are stackable on one another including cover 30, a hollow center ring 33 and a bottom disc 36. Device 10 further includes a hinge bracket 40 connecting center ring 33 to the transverse pipe 23. Hinge bracket 40 is rotatable on transverse pipe 23.

A plurality of chain elements 50, namely 50*a*, 50*b*, 50*c*, 50*d*, 50*e* (not shown), 50*f* (not shown), 50*g* (not shown), 50*h* (not shown), are circumferentially spaced along center ring 33. There are approximately eight chain elements 50 although that number can vary and the present invention contemplates fewer or a greater number of chain elements 50. The chain elements 50 are either chains or they are aviation-type cables, which have better strength. The aviation cables would be one quarter inch or larger and would have a plastic or rubber coating around the cable. In a preferred embodiment chain elements 50 are spaced roughly ten inches apart or slightly less so that the diameter of center ring 33 is approximately two feet. That diameter is the outer diameter. This allows most people to comfortably fit through the center ring 33 and escape to the escape floor 100 using the device 10, as will be further explained below. However, the center ring 33 can come in sizes of not just 24 inch diameter but 36 inch diameter in order to accommodate the largest width person.

Figure 3:
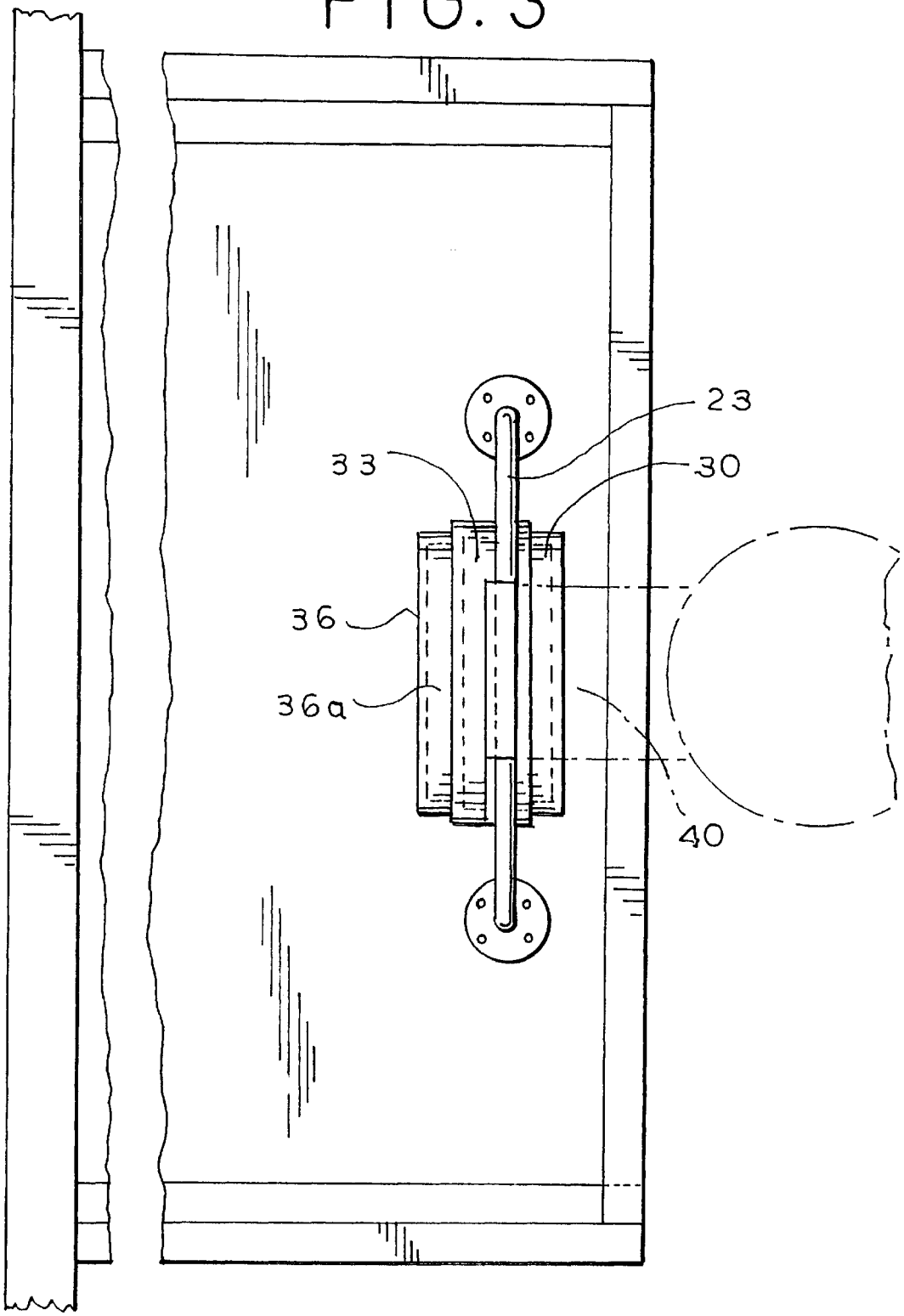
FIG. 3 is a top plan view of the fire escape device of the present invention in stored position.
Figure 8:
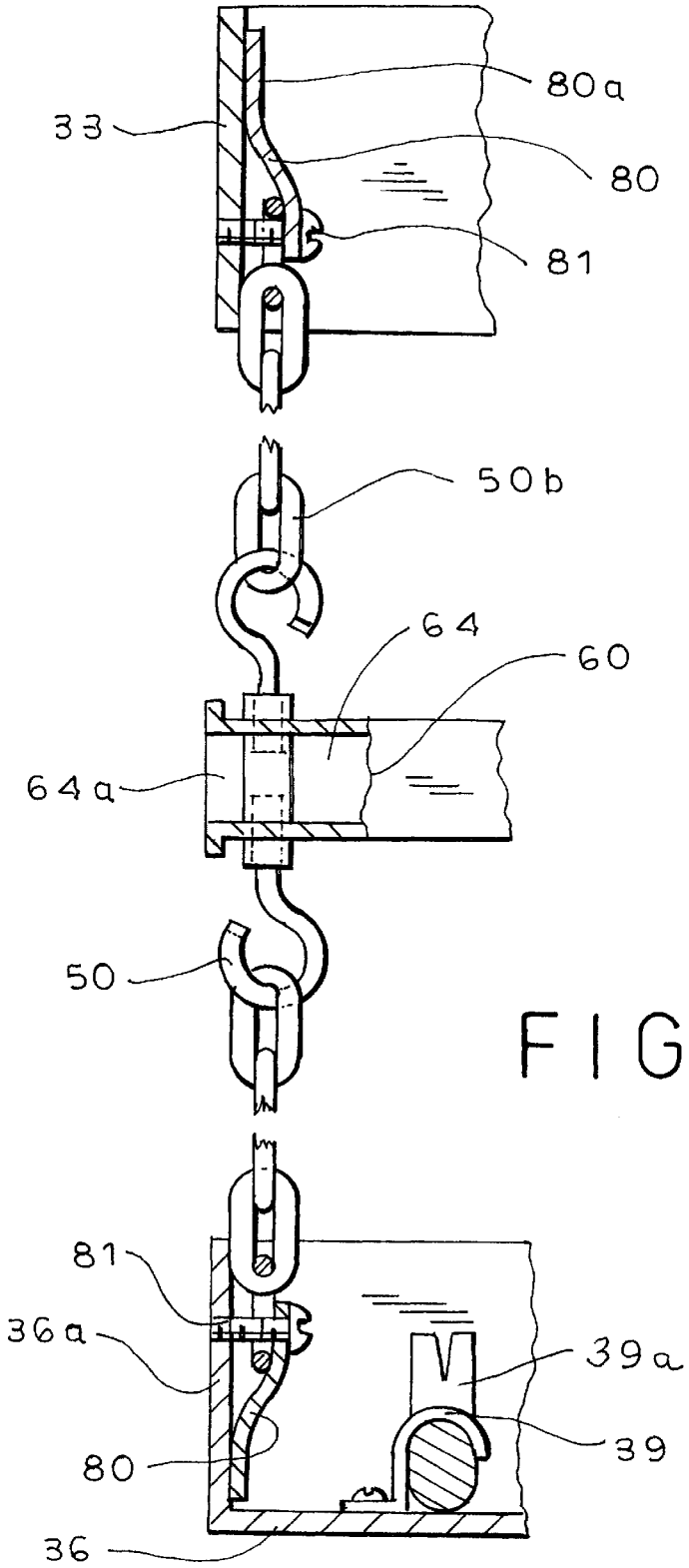
FIG. 8 is a vertical cross-sectional view showing the center ring and the bottom disc attaching to links of the chain elements and shows the chain element attaching to the steps of the ladder.

As best seen in FIG. 3 (dotted lines) and FIG. 8, the rings 30, 33, 36 are stackable because the inside diameter of center ring 33 is slightly greater than the outer diameters of the bottom disc 36 and of the cover 30, for example by one thirty second or one sixty fourth of an inch. Inside diameter of center ring 33 exceeds outside diameter of cover 30 and bottom disc by just enough to allow the walls of cover 30 and bottom disc 36 to slide just inside of center ring 33. Accordingly when the rings 30, 33, 36 are stacked together, walls 30*a* of cover 30 slides just inside of center ring 33 and is blocked by and rests on the straight edge 80*a* of "S" bracket 80. "S" bracket assembly includes "S" bracket 80 and bolt 81. Also, wall 36*a* of bottom disc 36 slides just inside of center ring 33 is blocked by and rests on bolt 81 going through "S" bracket 80 in center ring 33.

Preferably, for the greatest stability and durability, "S" bracket 80 forms a continuous lip or flange around inner circumference of center ring 33 and around bottom disc 36. Alternatively, discrete "S" brackets 80 for each chain element could be used.

Ladder 60 has as its vertical sides two adjacent chain elements, for example chain elements 50*b*, 50*c* of the plurality of chain elements 50 and ladder 60 includes a series of steps 61, 62, 63, 64, . . . 67, 68, etc. such that the vertical sides of ladder 60 formed from two chain elements of the plurality of chain elements 50 (preferably adjacent chain elements such as 50*b*, 50*c*) attach to a first and second end of each step, e.g. for step 64 ends 64*a* and 64*b*. Obviously, the number of steps in ladder 60 is not limited to six and would be approximately ten or in general any number suitable to allow ladder 60 to traverse the distance from railing 90 of patio 99 to a suitable escape location which is usually the floor below patio 99. As best seen in FIG. 8, the series of links that make up chain elements 50*b*, 50*c* that form vertical sides of ladder 60 are interrupted by each of the steps 61, 62 etc of ladder 60. As such, it is preferable that a separate series of links runs from a step to an adjacent step, for example from step 63 to step 64 and from step 63 to step 62.

In the event that chain elements 50 are aviation cables rather than chains, there would still be "S" bracket 80 and the aviation cable would then be connected to center ring 33 and bottom disc 36 in any suitable well known manner such as having the cable wrapped around bolt 81 and sealed with a press coupling. The cable would connect to the steps 61, 62, 63, 64, . . . 67, 68, etc. of ladder 60 the same way as a chain would or else through other known methods such as being wrapped around each step 61, 62, etc. of ladder 60 and pressed with a cable coupling bracket.

The distance from the top of ladder 60 to step 61 should be approximately eighteen inches in order to give ample room for a person escaping to climb through center ring 33 securely to step 61 of ladder 60. Furthermore, it is preferable that the steps 61, 62, etc. of ladder 60 have a nonskid top surface.

In escape mode position, the plurality of chain elements 50 and the ladder 60 hang down from the center ring 33 and terminate at bottom disc 36. FIG. 8 is a vertical cross-sectional view showing the center ring and the bottom disc attaching to the links of chain element 50 and showing chain element 50 attached to ladder 60.

Although the present invention contemplates any secure means of connection between the chain elements 50 and the bottom disc 36 and between chain elements 50 and center ring 33, a particular means of connection is depicted in FIG. 8, namely "S" bracket 80 welded or screwed to bottom disc 36 whereby bolt 81 runs through the aperture formed by link 53 of chain element 50 and bolt 81 penetrates bottom disc 36 securely. A similar means of connection is employed between center ring 33 and chain elements 50. For example, "S" bracket 80 is welded or screwed to cover 30 and bolt 81 runs through aperture formed by link 51 of chain elements 50 and center ring 33.

It should be noted that plurality of chain elements 50 forms a safety feature in device 10. If during the stress of the emergency the individual who climbs down ladder 60 were to lose balance and start to fall that individual is provided by device 10 with the ability to grab hold of any of the hanging chain elements 50 which form a circle all around him—and this is not limited to the two chain elements that form the vertical sides of the ladder 60—and thereby save himself.

Figure 4:
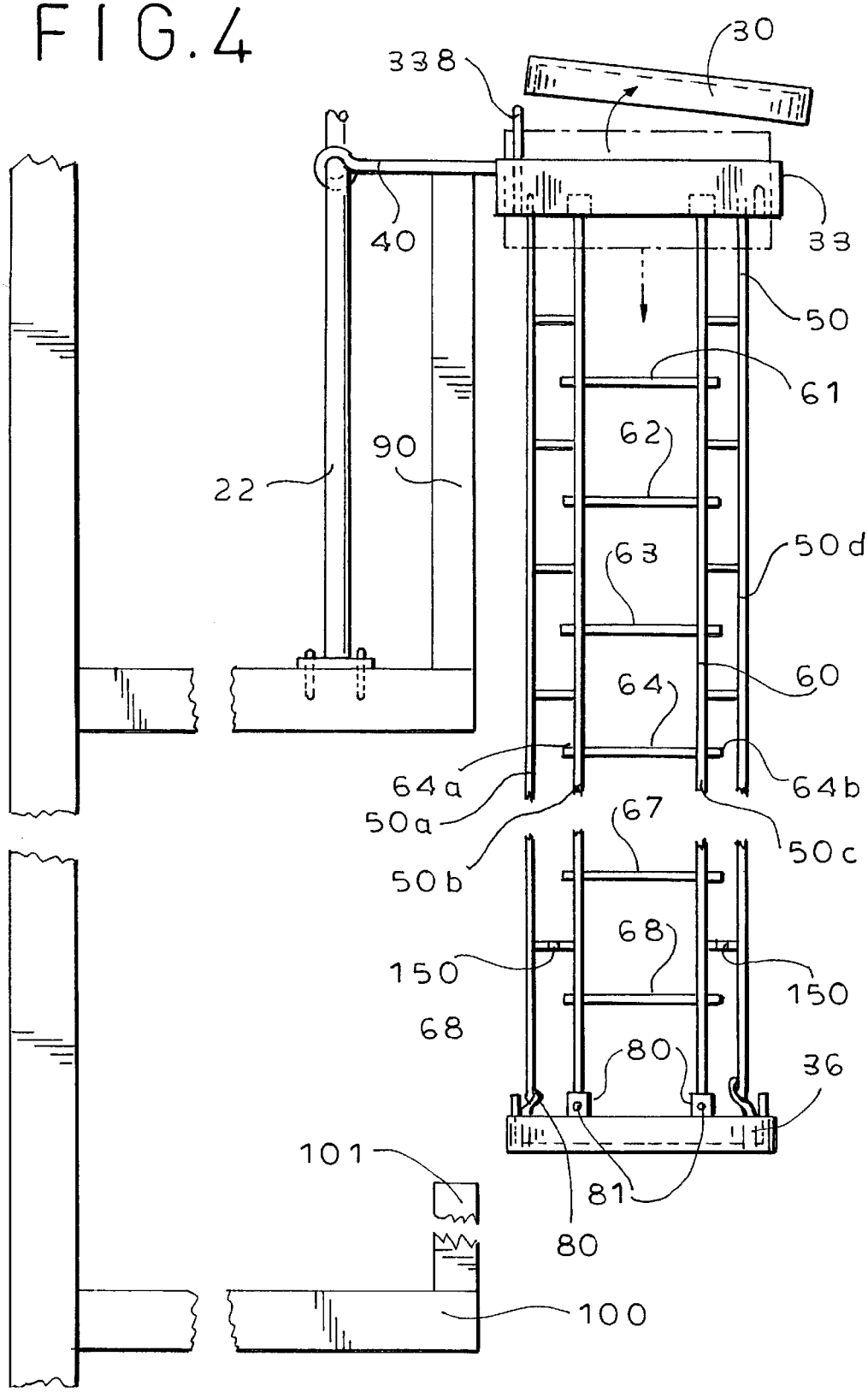
FIG. 4 is a side elevational view of the fire escape device of the present invention in active mode.

As best seen in FIG. 4, a further safety feature of device 10 is the existence, in the preferred embodiment, of a plurality of horizontal connective chains 150 that attach to and connect adjacent chain elements 50 to one another. Horizontal connective chains 150 are attached to but do not connect, chain elements 50*b*, 50*c* that form vertical sides of ladder 60 to one another since that might interfere with walking down the ladder 60. The reason horizontal connective chains 150 attach to chain elements 50*b*, 50*c* that form vertical sides of ladder 60 is that they attach vertical sides of ladder 60 to other chain elements 50—for example chain element 50*b* is connected to chain element 50*a* via horizontal connective chain 150.

As a result of horizontal connective chains 150, if an individual climbing down ladder 60 were to lose balance and start to fall by extending his hand he could brace himself with the horizontal connective chains 150 with even less effort than that needed to brace himself by grabbing chain element 50. Horizontal connective chain 150 are lightweight and need not be as thick as chain element 50. When the plurality of chain elements 50 and the ladder 60 hang from the center ring 33 in active mode the plurality of horizontal connective chains 150 hangs with them.

When device 10 is in stored position, such as in FIG. 1, the ladder 60 and chain elements 50—and in the preferred embodiment also the horizontal connective chains 150—are stored in the stacked annular ring elements 30, 33, 36, namely cover 30, center ring 33 and bottom disc 36. When device 10 is hanging in stored position and the annular ring elements 30, 33, 36 are stacked, hinge bracket 40 is then perpendicular to the floor of the patio 99 and the device 10 hangs on the transverse pipe 23.

As best seen in FIG. 2, which depicts a side elevational view of the device in stored position and shows broken lines to illustrate a portion of device 10 in active position or escape mode, the active or escape position of the device is reached by rotating the hinge bracket 40 from its rest position pointing to the floor of patio 99 approximately 270 degrees so that the hinge bracket 40 comes to rests on outer railing 90 of the patio 99. The distance from piping 20 to outermost part of outer railing 90 is roughly equal to or smaller than the length of hinge bracket 40. Device 10 will be made with various lengths hinge bracket 40 to accommodate different widths of railing 90. As a result, ring elements 30, 33, 36 extend just beyond outer patio railing 90 thereby allowing plurality of chain elements 50, ladder 60 and bottom disc 36 unimpeded freedom to fall and hang from center ring 33. Cover 30 is also removed by its handle (not shown) just after ring elements 30, 33, 36 are swung over railing 90 into escape mode position.

In the active position or escape mode of the device, the plurality of chain elements 50, the ladder 60 and the bottom disc 36 reach an escape floor 100 below patio 99. Although it may appear from FIG. 4 that the ladder reaches only railing 101 on escape floor 100, it is preferable that ladder 60 be sufficiently long so that it reach the actual level of escape floor 100.

Entire device 10 is made of 16 or 18 gauge noncorrosible aluminum so that device 10 can be lightweight for convenient storage while at the same time be able to resist fire and be sturdy and strong enough to comfortably hold at least one heavy individual walking down the ladder 60, and preferably such an individual carrying a child. Therefore each step 61, 62 etc. of ladder 60 as well as bottom disc 36, being made of noncorrosible aluminum of 16 to 18 gauge should be able to hold at least 350 and preferably approximately 400 to 500 pounds or more.

The device 10 of the present invention is also designed to permits several optional features that function with and as part of the basic elements of device 10 either individually or combined together in order to enhance the value of device 10 at the critical emergency moment, such as a fire. These optional features are as follows. First, device 10 can include an alarm so that when device 10 is flipped 270 degrees from its storage position to its escape position, the alarm signals the doorman that there is a fire in the building.

As seen best in FIG. 2, toward the bottom of outer railing 90 is protruding a pronged electric conduit jack 120 that makes contact with and connects by well known means to handle element 123 of cover 30. Jack 120 forms part of a circuitbreaking element that normally suppresses or deactivates the alarm and is capable of transmitting an alarm signal by wire to a remotely located station when the cover is separated from the jack and the circuit is broken. The connection between cover 30 and jack 120 completes an electric circuit. This connection is broken and the alarm goes off when the cover is separated from the jack, as happens when device 10 is rotated into active position. This alarm system is well known and is akin to the alarms commonly found on home windows to prevent burglary which feature a taped wire element going around the window. The jack 120 is connected by wiring all the way to the doorman station in the lobby of the building—or any other suitable place—to signal a fire. Handle element 123 (only shown in FIG. 2) on cover 30 can also function as a handle to grab when removing cover 30 after hinge bracket 40 is rotated to activate device 10.

Second, one escaping a fire climbs down ladder 60 to escape floor 100 may find that no one is home in the apartment adjacent escape floor 100 and that the resident of such apartment lacks his own device 10 of the present invention. Accordingly, as best appreciated from FIG. 8, device 10 features an approximately 12 inch long mallet or hammer 39*a* that is removably attached to clip element 39 built into bottom disc 36 of device 10 thereby allowing the individual escaping to break through the window on escape floor 100 below.

Third, canopy means (not shown) may be used to increase the stability of center ring 33 in active position when an individual is about to climb through it. For example, a metal bar (not shown) connects an overhanging canopy to a small bracket 338 protruding from center ring 33 (see FIG. 6) and the small bracket 338 has an aperture in its center to receive a hook sticking out of the bar provides extra stability to center ring 33. Another advantage of small bracket 338 is it gives an individual escaping something to hold onto when climbing through center ring 33.

Figure 11:
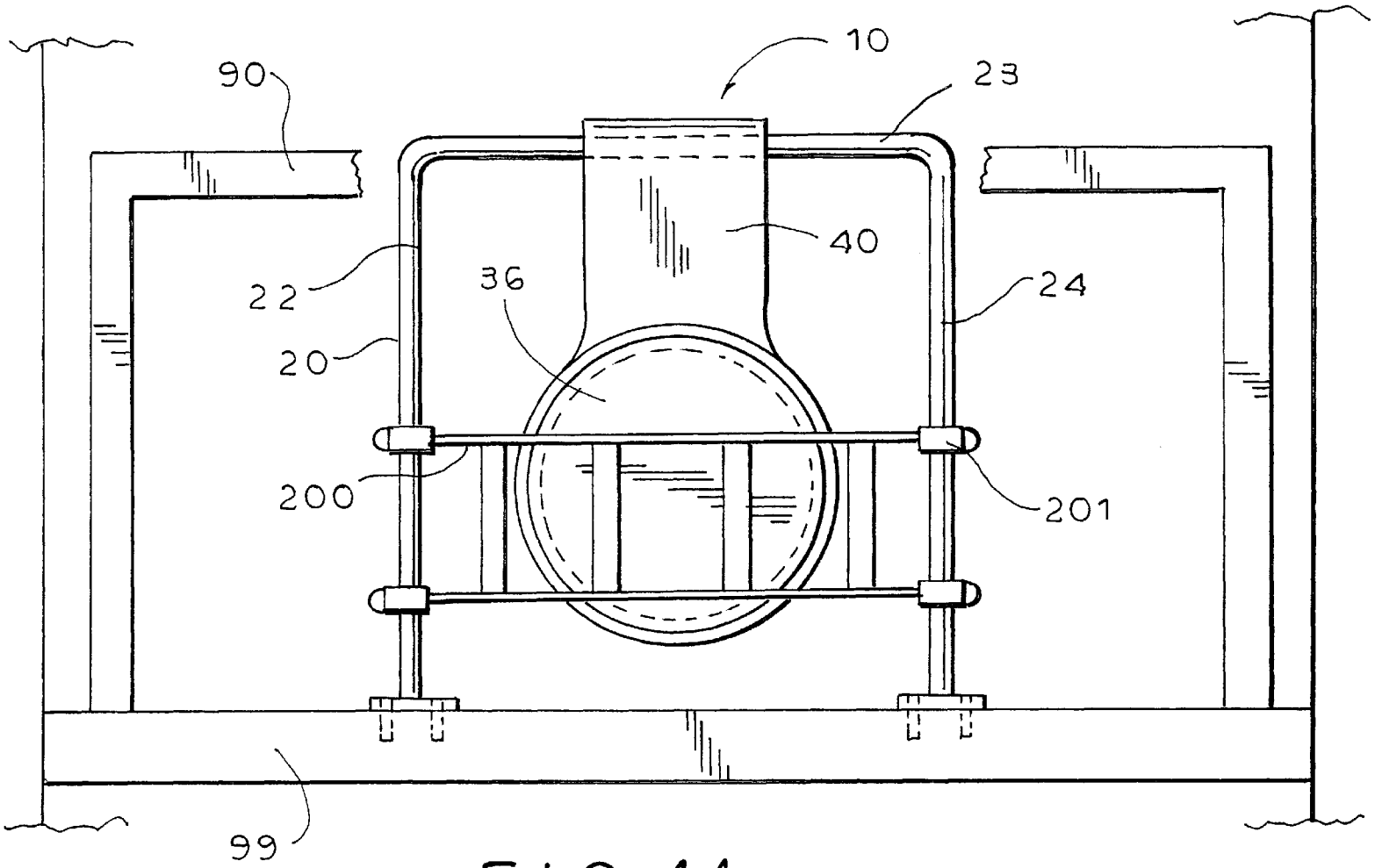
FIG. 11 is a front elevational view of the fire escape device of the present invention in stored position including the alternative piping shown in FIG. 9 and the convenience step ladder.
Figure 12:
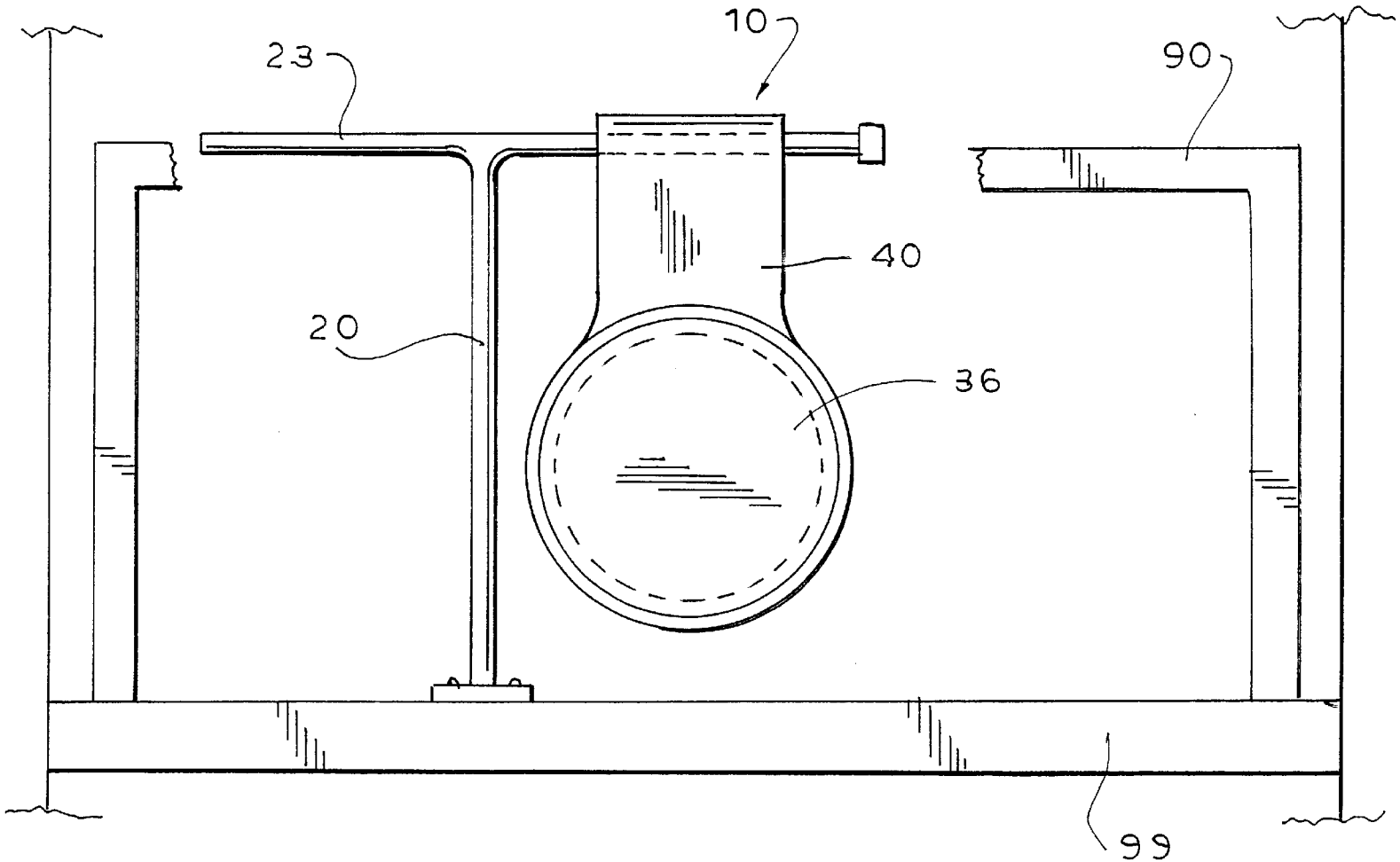
FIG. 12 is a front elevational view of an alternative embodiment of the piping of the fire escape device of the present invention shown in stored position.

Furthermore, the present invention also facilitates the process of climbing onto the hinge bracket to go into the center ring 33 to escape. In an alternative embodiment of the present invention best seen in FIG. 9, transverse piping 23 is bent in a middle section 23*a* thereof so that when device 10 is in stored position there is room for a step ladder 200 to be clipped to the piping because the bent transverse piping 23 allows hanging rings 30, 33, 36 and hinge bracket 40 to be set back a few inches toward railing 90 when device 10 is in stored position. Step ladder 200 facilitates climbing through center ring 33 This allows room for a convenience step ladder 200 to be horizontally stored and clipped by clipping elements 201 in order to eliminate easy release of step ladder 200 by children when no emergency exists. The convenience step ladder 200 is stored horizontally as best seen in FIG. 11. The step ladder 200 is removed, the device 10 is rotated 270 degrees into active position and then the step ladder 200 is placed vertically against device 10 to make it easy to ascend to hinge bracket 40 and climb through center ring 33.

FIG. 10 shows an alternative form of the convenience step ladder 200 and transverse piping 23 with the device 10 in active position.

The device 10 can be used also to escape from a large bedroom window rather than from a patio or from any large window in the living area of a high rise building. In such a case, the structure of device 10 is identical except that hinge bracket 40 would be somewhat longer in order to be able to swing out of the window. Moreover, in active position of the device 10, instead of hinge bracket 40 resting on outer railing 90 of patio 99, hinge bracket 40 would simply rest on the window ledge facing outdoor air. Also, jack 120 would extend from living area wall housing the window instead of protruding from outer railing 90. Also, if center ring 33 were connected to a canopy for added stability the canopy would likely be outside the window such as an awning attached to an outer facade of the building. Device 10 would be installed in the bedroom or other room in the living area next to a large window with the piping connected to the floor of that room rather than to the floor of the patio.

It should be noted that although in the preferable embodiment piping 20 includes at least two vertical pipes 22, 24 that combine with transverse pipe 23 to from roughly an upside down "U", theoretically alternatives (not shown) within the spirit of the present invention can be imagined wherein only one very sturdy vertical upright pipe 22 would be sufficient if it connected to transverse pipe 23 such that piping 20 formed a "T" formation. This is provided vertical pipe 22 allowed enough room on at least one side of the "T" for hinge bracket 40 to hang.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A fire escape assembly device for high rise buildings having a patio including an outer railing on an above-ground building floor, comprising:

piping, wherein each of two vertical upright pipes are securable to a floor of the patio and a transverse pipe runs approximately perpendicular to and connects the vertical upright pipes, to be approximately parallel to a floor of the patio.

three annular ring elements stackable on one another including a cover, a hollow center ring and a bottom disc, a hinge bracket connecting the center ring to the transverse pipe, said hinge bracket rotatable on the transverse pipe and being of a length to cover a distance between the piping and the outer railing, a plurality of chain elements circumferentially spaced around the center ring, a ladder including vertical sides formed from two adjacent chain elements of the plurality of chain elements and including a series of steps, the vertical sides of the ladder attaching to a first and second end of each step, the plurality of chain elements and the ladder hanging from the center ring and terminating at the bottom disc, wherein when the device is in stored position the ladder and chain elements are stored in the annular ring elements, the annular ring elements are stacked, the hinge bracket is perpendicular to the transverse pipe and the device hangs on the transverse piping and wherein an active position of the device is reached by rotating the hinge bracket approximately 270 degrees for the hinge bracket to rest on the outer railing of the patio thereby allowing the plurality of chain elements, the ladder and the bottom disc to fall and hang from the center ring and wherein the cover is removed, and wherein in the active position of the device, the plurality of chain elements, the ladder and the bottom disc are positionable adjacent to an escape floor below the floor of the patio.

2. The fire escape assembly device of claim 1, wherein a plurality of horizontal connective chains are attached to and connect adjacent chain elements to one another and wherein said plurality of horizontal connective chains are attached to but do not connect adjacent chain elements that form the vertical sides of the ladder to one another.

3. The fire escape assembly device of claim 1, including a jack forming part of a circuitbreaking element and attachable to and extendable from the outer railing and connecting to the cover, the connection between the cover and the jack completing an electric circuit, wherein the circuitbreaking element transmits an alarm signal by electric wire to a remotely located station when the cover is separated from the jack and the circuit is broken.

4. The fire escape assembly device of claim 1, wherein transverse piping is bent in a middle section thereof so that when the device is in stored position there is room for a step ladder to be clipped to the piping to facilitate climbing through the center ring.

5. The fire escape assembly device of claim 1, wherein a small bracket having an aperture protrudes from the center ring and allows the center ring to be attached to an overhead canopy for increased stability when the device is in active position.

6. The fire escape assembly of claim 1, wherein a mallet is removably attached to the bottom disc and wherein the device includes a jack forming part of a circuitbreaking element and attachable to and extendable from the outer railing and connecting to the cover, wherein the connection between the cover and the jack completes an electric circuit, and wherein the circuitbreaking element transmits an alarm signal by electric wire to a remotely located station when the cover is separated from the jack and the circuit is broken.

7. The fire escape assembly of claim 1, wherein a mallet is removably attached to the bottom disc and wherein the device includes a jack forming part of a circuitbreaking element and attachable to and extendable from the outer railing and connecting to the cover, wherein the connection between the cover and the jack completes an electric circuit, wherein the circuitbreaking element transmits an alarm signal by electric wire to a remotely located station when the cover is separated from the jack and the circuit is broken and wherein transverse piping is bent in a middle section thereof so that when the device is in stored position there is room for a step ladder to be clipped to the piping to facilitate climbing through the center ring.

8. The fire escape assembly device of claim 1, wherein a plurality of horizontal connective chains are attached to and connect adjacent chain elements to one another and wherein said plurality of horizontal connective chains are attached to but do not connect adjacent chain elements that form the vertical sides of the ladder to one another, wherein a mallet is removably attached to the bottom disc and wherein the device includes a jack forming part of a circuitbreaking element and attachable to and extendable from the outer railing and connecting to the cover, wherein the connection between the cover and the jack completes an electric circuit, wherein the circuitbreaking element transmits an alarm signal by electric wire to a remotely located station when the cover is separated from the jack and the circuit is broken.

9. A fire escape assembly device for high rise buildings having a patio including an outer railing on an above-ground building floor, comprising:

piping, wherein each of two vertical upright pipes are securable to a floor of the patio and a transverse pipe runs approximately perpendicular to and connects the vertical upright pipes, to be approximately parallel to a floor of the patio.

three annular ring elements stackable on one another including a cover, a hollow center ring and a bottom disc, a hinge bracket connecting the center ring to the transverse pipe, said hinge bracket rotatable on the transverse pipe and being of a length to cover a distance between the piping and the outer railing, a plurality of chain elements circumferentially spaced around the center ring, a ladder including vertical sides formed from two adjacent chain elements of the plurality of chain elements and including a series of steps, the vertical sides of the ladder attaching to a first and second end of each step, the plurality of chain elements and the ladder hanging from the center ring and terminating at the bottom disc, wherein when the device is in stored position the ladder and chain elements are stored in the annular ring elements, the annular ring elements are stacked, the binge bracket is perpendicular to the transverse pipe and the device hangs on the transverse piping and wherein an active position of the device is reached by rotating the hinge bracket approximately 270 degrees for the hinge bracket to rest on the outer railing of the patio thereby allowing the plurality of chain elements, the ladder and the bottom disc to fall and hang from the center ring and wherein the cover is removed, and wherein in the active position of the device, the plurality of chain elements, the ladder and the bottom disc are positionable adjacent to an escape floor below the floor of the patio, and wherein an inside diameter of the center ring exceeds an outside diameter of the cover and exceeds an outside diameter of the bottom disc just enough to allow a wall of the bottom disc and a wall of the cover to slide just inside of the center ring and wherein the wall of the bottom disc and the wall of the cover rest on an "S" bracket assembly which includes an "S" bracket welded to the center ring.

10. The fire escape assembly device of claim 9, wherein a plurality of horizontal connective chains are attached to and connect adjacent chain elements to one another and wherein said plurality of horizontal connective chains are attached to but do not connect adjacent chain elements that form the vertical sides of the ladder to one another.

11. The fire escape assembly device of claim 9, including a jack forming part of a circuitbreaking element and attachable to and extendable from the outer railing and connecting to the cover, the connection between the cover and the jack completing an electric circuit, wherein the circuitbreaking element transmits an alarm signal by electric wire to a remotely located station when the cover is separated from the jack and the circuit is broken.

12. The fire escape assembly device of claim 9, including a jack forming part of a circuitbreaking element and attachable to and extendable from the outer railing and connecting to the cover, the connection between the cover and the jack completing an electric circuit, wherein the circuitbreaking element transmits an alarm signal by electric wire to a remotely located station when the cover is separated from the jack and the circuit is broken, wherein a plurality of horizontal connective chains are attached to and connect adjacent chain elements to one another and wherein said plurality of horizontal connective chains are attached to but do not connect adjacent chain elements that form the vertical sides of the ladder to one another, and wherein a mallet is removably attached to the bottom disc.

13. A fire escape assembly device for use in a high rise buildings having a large window next to a window ledge in a living area extending to the outside on an above-ground building floor, comprising:

piping, wherein each of two vertical upright pipes are securable to a floor of the patio and a transverse pipe runs approximately perpendicular to and connects the vertical upright pipes, to be approximately parallel to a floor of the living area.

three annular ring elements stackable on one another including a cover, a hollow center ring and a bottom disc, a hinge bracket connecting the center ring to the transverse pipe, said hinge bracket rotatable on the transverse pipe and being of a length to cover a distance between the piping and the window ledge, a plurality of chain elements circumferentially spaced around the center ring, a ladder including vertical sides formed from two adjacent chain elements of the plurality of chain elements and including a series of steps, the vertical sides of the ladder attaching to a first and second end of each step, the plurality of chain elements and the ladder hanging from the center ring and terminating at the bottom disc, wherein when the device is in stored position the ladder and chain elements are stored in the annular ring elements, the annular ring elements are stacked, the hinge bracket is perpendicular to the transverse pipe and the device hangs on the transverse piping and wherein an active position of the device is reached by rotating the hinge bracket approximately 270 degrees for the hinge bracket to rest on the window ledge thereby allowing the plurality of chain elements, the ladder and the bottom disc to fall and hang from the center ring and wherein the cover is removed, and wherein in the active position of the device, the plural of chain elements, the ladder and the bottom disc are positionable adjacent to an escape floor below the building floor of the living area.

14. The fire escape assembly device of claim 13, wherein a plurality of horizontal connective chains are attached to and connect adjacent chain elements to one another and wherein said plurality of horizontal connective chains are attached to but do not connect adjacent chain elements that form the vertical sides of the ladder to one another.

15. The fire escape assembly device of claim 13, including a jack forming part of a circuitbreaking element and attachable to and extendable from a living area wall under the window ledge and connecting to the cover, the connection between the cover and the jack completing an electric circuit, wherein the circuitbreaking element transmits an alarm signal by electric wire to a remotely located station when the cover is separated from the jack and the circuit is broken.

16. The fire escape assembly device of claim 13, wherein transverse piping is bent in a middle section thereof so that when the device is in stored position there is room for a step ladder to be clipped to the piping to facilitate climbing through the center ring.

17. The fire escape assembly device of claim 13, wherein a small bracket having an aperture protrudes from the center ring and allows the center ring to be attached to an overhead canopy for increased stability when the device is in active position.

18. The fire escape assembly of claim 13, wherein a mallet is removably attached to the bottom disc and wherein the device includes a jack forming part of a circuitbreaking element and attachable to and extendable from a living area wall under the window ledge and connecting to the cover, wherein the connection between the cover and the jack completes an electric circuit, and wherein the circuitbreaking element transmits an alarm signal by electric wire to a remotely located station when the cover is separated from the jack and the circuit is broken.

19. The fire escape assembly of claim 13, wherein a plurality of horizontal connective chains are attached to and connect adjacent chain elements to one another and wherein said plurality of horizontal connective chains are attached to but do not connect adjacent chain elements that form the vertical sides of the ladder to one another, wherein a mallet is removably attached to the bottom disc, wherein the device includes a jack forming part of a circuitbreaking element and attachable to and extendable from a living area wall under the window ledge and connecting to the cover, wherein the connection between the cover and the jack completes an electric circuit, and wherein the circuitbreaking element transmits an alarm signal by electric wire to a remotely located station when the cover is separated from the jack and the circuit is broken.

20. A fire escape assembly device for use in a high rise buildings having a large window next to a window ledge in a living area extending to the outside on an above-ground building floor, comprising:

piping, wherein each of two vertical upright pipes are securable to a floor of the patio and a transverse pipe runs approximately perpendicular to and connects the vertical upright pipes, to be approximately parallel to a floor of the living are, three annular ring elements stackable on one another including a cover, a hollow center ring and a bottom disc, a hinge bracket connecting the center ring to the transverse pipe, said hinge bracket rotatable on the transverse pipe and being of a length to cover a distance between the piping and the window ledge, a plurality of chain elements circumferentially spaced around the center ring, a ladder including vertical sides formed from two adjacent chain elements of the plurality of chain elements and including a series of steps, the vertical sides of the ladder attaching to a first and second end of each step, the plurality of chain elements and the ladder hanging from the center ring and terminating at the bottom disc, wherein when the device is in stored position the ladder and chain elements are stored in the annular ring elements, the annular ring elements are stacked, the hinge bracket is perpendicular to the transverse pipe and the device hangs on the transverse piping and wherein an active position of the device is reached by rotating the hinge bracket approximately 270 degrees for the hinge bracket to rest on the window ledge thereby allowing the plurality of chain elements, the ladder and the bottom disc to fall and hang from the center ring and wherein the cover is removed, and wherein in the active position of the device, the plurality of chain elements, the ladder and the bottom disc are positionable adjacent to an escape floor below the building floor of the living area, and wherein an inside diameter of the center ring exceeds an outside diameter of the cover and exceeds an outside diameter of the bottom disc just enough to allow a wall of the bottom disc and a wall of the cover to slide just inside of the center ring and wherein the wall of the bottom disc and the wall of the cover rest on an "S" bracket assembly which includes an "S" bracket welded to the center ring.

21. The fire escape assembly device of claim 20, wherein the device includes a jack forming part of a circuitbreaking element and extending from a living area wall under the window ledge and connecting to the cover, the connection between the cover and the jack completing an electric circuit, wherein the circuitbreaking element transmits an alarm signal by electric wire to a remotely located station when the cover is separated from the jack and the circuit is broken.

22. The fire escape assembly of claim 20, wherein a mallet is removably attached to the bottom disc and wherein the device includes a jack forming part of a circuitbreaking element and attachable to and extendable from a living area wall under the window ledge and connecting to the cover, wherein the connection between the cover and the jack completes an electric circuit, wherein the circuitbreaking element transmits an alarm signal by electric wire to a remotely located station when the cover is separated from the jack and the circuit is broken and wherein a plurality of horizontal connective chains are attached to and connect adjacent chain elements to one another and wherein said plurality of horizontal connective chains are attached to but do not connect adjacent chain elements that form the vertical sides of the ladder to one another.

23. The fire escape assembly of claim 20, wherein a mallet is removably attached to the bottom disc and wherein the device includes a jack forming part of a circuitbreaking element and attachable to and extendable from a living area wall under the window ledge and connecting to the cover, wherein the connection between the cover and the jack completes an electric circuit, wherein the circuitbreaking element transmits an alarm signal by electric wire to a remotely located station when the cover is separated from the jack and the circuit is broken and wherein transverse piping is bent in a middle section thereof so that when the device is in stored position there is room for a step ladder to be clipped to the piping to facilitate climbing through the center ring.

24. A fire escape assembly device for high rise buildings having a patio including an outer railing on an above-ground building floor, comprising:

piping, including a vertical upright pipe securable to a floor of the patio and including a transverse pipe running approximately parallel to a floor of the patio such that the vertical and transverse pipes to be approximately parallel to a floor of the patio connect in a "T" formation to be approximately parallel to a floor of the patio, three annular ring elements stackable on one another including a cover, a hollow center ring and a bottom disc, a hinge bracket connecting the center ring to the transverse pipe, said hinge bracket rotatable on the transverse pipe and being of a length to cover a distance between the piping and the outer railing, a plurality of chain elements circumferentially spaced around the center ring, a ladder including vertical sides formed from two chain elements of the plurality of chain elements and including a series of steps, the vertical sides of the ladder attaching to a first and second end of each step, the plurality of chain elements and the ladder hanging from the center ring and terminating at the bottom disc, wherein when the device is in stored position the ladder and chain elements are stored in the annular ring elements, the annular ring elements are stacked, the hinge bracket is perpendicular to the transverse pipe and the device hangs on the transverse piping and wherein an active position of the device is reached by rotating the hinge bracket approximately 270 degrees for the hinge bracket to rest on the outer railing of the patio thereby allowing the plurality of chain elements, the ladder and the bottom disc to fall and hang from the center ring and wherein the cover is removed, and wherein in the active position of the device, the plurality of chain elements, the ladder and the bottom disc are positionable adjacent to an escape floor below the floor of the patio.

25. The fire escape assembly device of claim 24, wherein a plurality of horizontal connective chains are attached to and connect adjacent chain elements to one another and wherein said plurality of horizontal connective chains are attached to but do not connect adjacent chain elements that form the vertical sides of the ladder to one another.

26. The fire escape assembly device of claim 24, wherein a mallet is removably attached to the bottom disc, wherein the device includes a jack forming part of a circuitbreaking element and attachable to and extendable from the outer railing and connecting to the cover, the connection between the cover and the jack completing an electric circuit, and wherein the circuitbreaking element transmits an alarm signal by electric wire to a remotely located station when the cover is separated from the jack and the circuit is broken.

27. The fire escape assembly device of claim 24, wherein a small bracket having an aperture protrudes from the center ring and allows the center ring to be attached to an overhead canopy for increased stability when the device is in active position.

28. The fire escape assembly device of claim 24, wherein an inside diameter of the center ring exceeds an outside diameter of the cover and exceeds an outside diameter of the bottom disc just enough to allow a wall of the bottom disc and a wall of the cover to slide just inside of the center ring wherein the wall of the bottom disc and the wall of the cover rest on an "S" bracket assembly which includes an "S" bracket welded to the center ring.

* * * * *